United States Patent [19]

Ramsperger

[11] 4,236,594

[45] Dec. 2, 1980

[54] SYSTEM FOR AUTOMATICALLY CONTROLLING AUTOMOTIVE STARTING AND ACCESSORY FUNCTIONS

[75] Inventor: David C. Ramsperger, Phoenix, Ariz.

[73] Assignee: Skip D. McFarlin, Phoenix, Ariz. ; a part interest

[21] Appl. No.: 935,387

[22] Filed: Aug. 21, 1978

[51] Int. Cl.[3] ..... F02N 11/08

[52] U.S. Cl. ..... 180/167; 180/271; 290/38 E; 290/DIG. 3; 307/10 AT; 307/10 LS

[58] Field of Search ..... 180/167, 271; 290/DIG. 3, 38 C, 38 E; 49/197, 199, 357, 348, 349; 307/10 AT, 10 LS

[56] References Cited

U.S. PATENT DOCUMENTS

| | | | |
|---|---|---|---|
| 3,553,472 | 1/1971 | Arlandson | 290/DIG. 3 |
| 3,633,040 | 1/1972 | Baxter | 290/DIG. 3 |
| 3,756,341 | 9/1973 | Tonkowich | 180/114 |
| 4,013,875 | 3/1977 | McGlynn | 244/3.15 X |
| 4,131,304 | 12/1978 | Wagner | 290/38 C |

*Primary Examiner*—John J. Love
*Assistant Examiner*—D. W. Underwood
*Attorney, Agent, or Firm*—Cahill, Sutton & Thomas

[57] ABSTRACT

A microprocessor based system for remote starting of an automobile engine includes circuitry for automatically actuating an accelerator of the automobile to effect starting of the engine, circuitry for energizing the starter motor for a predetermined number of seconds, repeating energizing of the engine a predetermined number of times if the engine does not start, and providing a predetermined delay between each energizing of the automobile engine. A remote transmitter transmits a start command to a receiver located in the automobile, causing the receiver to cause an algorithm stored in the microprocessor to attempt to start the engine and control certain accessories. A fail-safe accessory control algorithm stored in the microprocessor system effects energizing and de-energizing accessory control motors in accordance with signals from position sensors which detect positions of moveable components of an accessory and effects de-energizing the accessory control motor after a predetermined number of seconds if a position sensor signal does not indicate that the accessory component being moved has actuated a position sensor.

5 Claims, 19 Drawing Figures

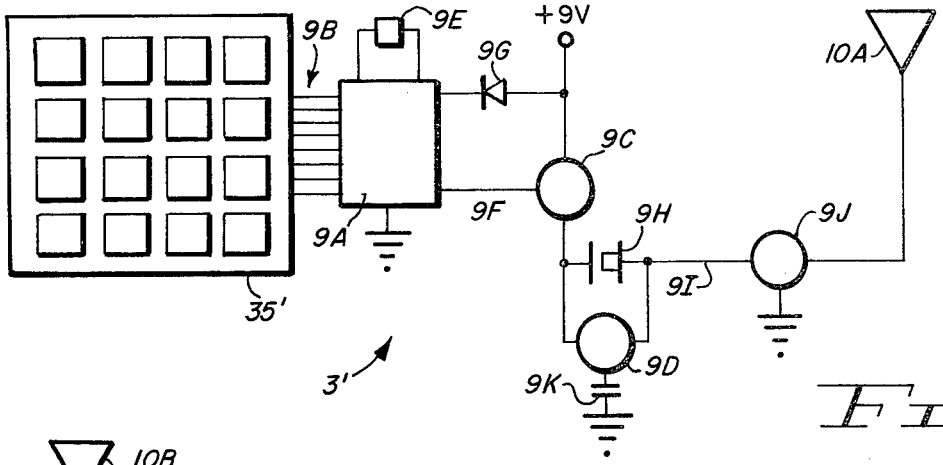
FIG. 6A
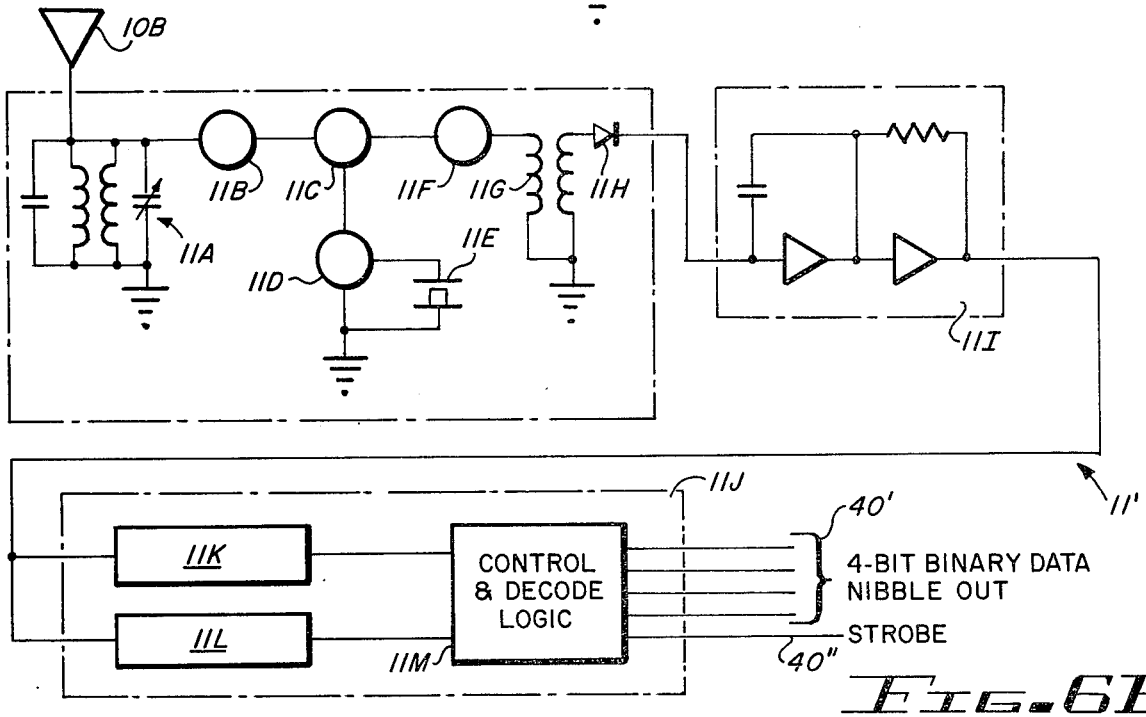
FIG. 6B
FIG. 2B
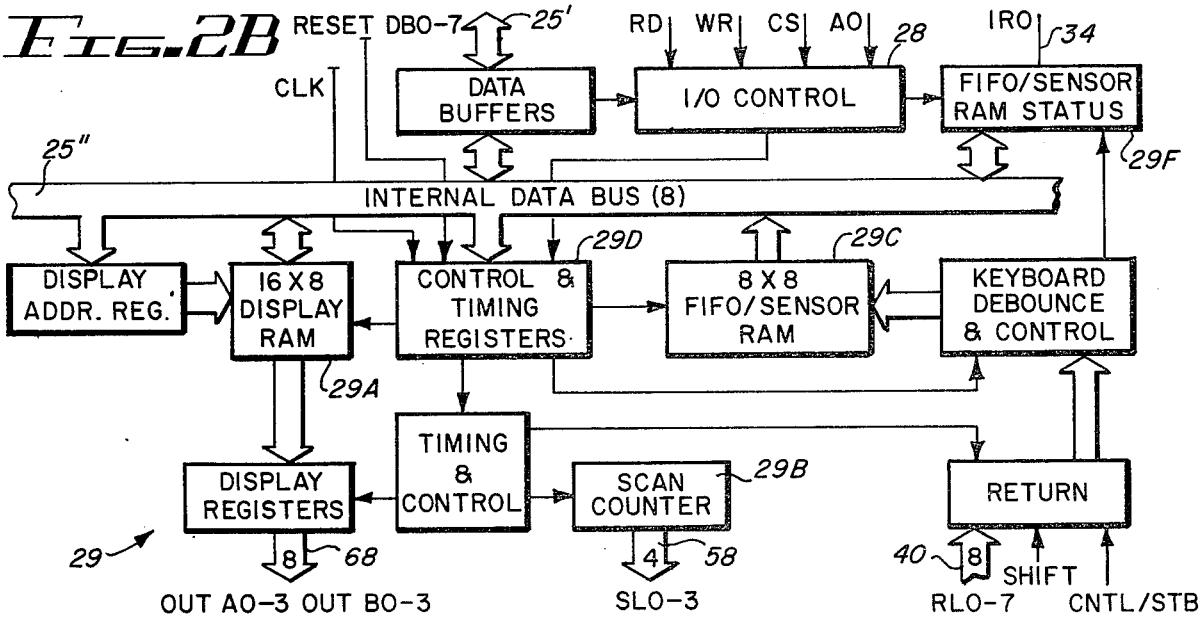

SYSTEM FOR AUTOMATICALLY CONTROLLING AUTOMOTIVE STARTING AND ACCESSORY FUNCTIONS

BACKGROUND OF THE INVENTION

1. Field of the Invention

The invention relates to systems and methods for controlling automotive functions, and particularly to processor based systems and methods for automatically starting an automobile engine and controlling accessory devices in the automobile.

2. Description of the Prior Art

Those skilled in the art recognize that the automobile market is highly competitive, and that it is therefore necessary that automotive electronic systems for performing various functions be very economical and highly reliable before such automotive electronic systems can be incorporated into automobiles to replace functions previously performed by mechanical and/or conventional automotive electrical systems. It is well known that the automotive electrical environment is a particularly harsh environment for electrical components, since large amounts of electrical noise and high energy transient voltages capable of destroying conventional semiconductor electronic components can occur under certain circumstances. Because of the practical difficulties involved in implementing electronic systems in automobiles, it is necessary that decisions to utilize electronic components in automobiles be made very carefully, and that extensive experimentation and testing be performed to arrive at combinations of electronic components which will economically, safely, and reliably perform the desired functions.

A variety of automotive electronic systems have been utilized in the past. Such systems have been mainly utilized to perform highly complex functions in an automobile, for example, by controlling ignition timing and controlling fuel injection or carburetion systems as functions of a variety of engine parameters, such as instantaneous acceleration, manifold pressure, engine temperature, oil temperature, fuel temperature, and atmospheric pressure. Other applications of prior automotive electronic systems include electronic anti-skid systems for controlling the braking operation for each wheel automatically to prevent an automobile from skidding sideways when the brakes are slammed on during an emergency stopping situation. Both analog electronic systems and digital processor control systems have been utilized to perform such functions. Another function which has been performed by known microprocessor based systems is that of monitoring various sensors in an automobile and displaying parameters measured by sensors in digital form. Such parameters include engine speed, automobile speed, temperature, fuel consumption rate, and distance travelled between various points. The above-mentioned known systems are complex, and have involved enormous amounts of engineering expense. However, the expense has been considered to be justified by the importance of the objectives to be obtained, including providing more economical engine operation, thereby decreasing consumption of increasingly scarce petroleum fuel and reducing the concentration of automotive emissions, in line with requirements of the United States Environmental Protection Agency.

U.S. Pat. Nos. 3,846,760 (Ironside); 3,838,397 (Watson); 4,053,868 (Cox); 3,964,302 (Gordon) are generally indicative of the state of the art for automobile engine control and monitoring systems.

However, complex electronic automotive systems have not been utilized to perform relatively un-complex operations, such as turning headlights on and off, opening and closing windows, locking and unlocking doors, and turning heating and air conditioning units on and off. The conventional controls for performing such functions are relatively inexpensive, safe to use, convenient to use, and reliable. Computer based electronic systems have not been utilized to control ignition switches and to automatically start automobiles for essentially the same reasons. However, there are many persons who would like to have an automatic system for providing performing the above functions, especially on relatively expensive luxury automobiles. There is an untapped market for systems which could be either incorporated into automobiles during their manufacture or added on by the owners for automatically performing the usual accessory control and starting functions of an automobile by entering commands into a keyboard in the passenger compartment, or, even more desirably, on a remote keyboard coupled to a remote transmitter which transmits remotely entered commands to the automobile.

It is therefore an object of the invention to provide an economical, reliable, and safe electronic control system for automatically performing various accessory control functions in an automobile in response to either locally or remotely entered commands.

It is another object of the invention to provide an economical, reliable, and safe electronic control system for automatically starting an automobile and controlling various accessory control functions in the automobile in response to entered commands.

During cold or hot weather conditions, it is desirable that an automobile driver be able to start his car from within his home or office to permit the engine to "warm up". It is also desirable for the driver to be able to turn on the automobile heater or air conditioner or roll the windows up or down from a remote location. It is further desirable that the driver be able to easily and conveniently unlock all of the doors of his automobile by utilizing a remote control device. Various remote engine starting systems for automobiles and other vehicles are known. For example, U.S. Pat. No. 3,675,032 discloses a cable-connected remote starting system for starting a vehicle's engine and operating the heater control. U.S. Pat. No. 3,696,333 (Mott) discloses a remote automobile engine starting system utilizing a remote transmitter. U.S. Pat. No. 3,790,806 (Lessard) discloses a remotely controlled automotible engine starting system and accessory control system utilizing a radio transmitter. U.S. Pat. No. 4,013,875 discloses a microprocessor-based system for monitoring the operational status of and actuating an operation performing element in a vehicle such as a tractor. However, the known remote control starting systems do not test the temperature of the engine or actuate the accelerator if the engine is cold. The known automatic engine starting devices do not automatically make a predetermined number of attempts to start the engine in response to a single command if the initial attempt or subsequent attempts are unsuccessful.

It is therefore another object of the invention to provide an automatic starting system which automatically makes a predetermined number of attempts to start the engine if the intial and subsequent attempts are unsuccessful.

It is another object of the invention to provide an economical, safe, reliable system and method for automatically starting an automobile engine regardless of the engine temperature.

It is another object of the invention to provide an economical, safe, reliable system for automatically starting an automobile engine which does not excessively "flood" the engine with fuel or excessively drain the automobile's battery if the engine fails to start.

Automotive control devices must be sufficiently reliable and easily operated that the average driver will be unlikely to experience difficulty operating the automobile as a result of activating the wrong control. Although keyboards have been utilized to enter information into an automotive location determining system, and have been commonly used to enter digital information into computing systems, a "fail-safe" data entry system is necessary for a digital automotive control system to avoid actuation of control functions which would be dangerous or disruptive to driving of the automobile.

It is therefore an object of the invention to provide a safe system for entry of operating control information and/or accessory control information into an automotive electronic system.

It is another object of the invention to provide a keyboard data entry system for rejecting commands which are improperly and/or inadvertently entered into an automotive electronic control system.

Automobiles ordinarily have twelve volt electrical systems powered by twelve volt batteries. If an automobile's battery has excessive charge drained therefrom, for example, because an accessory such as a headlight has been inadvertently left on, the automobile will not start. Damage to an automobile's electrical system may occur when too many high current devices are activated simultaneously.

It is therefore another object of the invention to provide an automotive automatic starting and accessory control system which presents excessive current drain from the automobile's battery due to failure of various electrical or mechanical control components of the automobile or due to simultaneous operation of an excessive number of high current accessories or components of the automobile.

In view of the foregoing considerations, it is an overall object of the invention to provide an economical, reliable, and safe automobile starting and accessory control system which overcomes the above shortcomings of the prior art.

SUMMARY OF THE INVENTION

Briefly described, and in accordance with one embodiment thereof, the invention provides an automatic engine starting system and method for an automobile. In one embodiment of the invention, the system and method also automatically controls various accessories of the automobile. The system includes a processor which receives command signals entered by depressing keys of a local keyboard. Signals from the keyboard are encoded by a keyboad encoding system to produce encoded command signals. The command signals may alternatively be entered by means of a remote keyboard connected to a remote transmitter. The remote transmitter transmits the command signals from the remote keyboard to a receiver mounted in the automobile. The signals received by the receiver are detected and decoded to produce corresponding encoded command signals which are entered into the processor system. The processor, which may be performing tasks (such as executing a digital dash display routine) unrelated to engine starting or accessory control, is interrupted in response to the encoded command signals and tests the validity of the encoded command signals to determine if a valid command is being entered. A valid command requires a valid sequence of encoded command signals produced in response to the local or mote keyboard. Each encoded command signal has a numerical weight associated therewith. The sum of the weights associated with the encoded command signals is tested to determine if that sum has a permissible value. The numerical weight associated with one of the command signals is then tested to determine which command was entered. The processor then calls a display subroutine corresponding to the entered command and transmits display information to an alphanumeric digital display system which displays the command entered by the driver of the automobile. If the driver has attempted to enter an invalid command sequence by depressing an invalid sequence of keys on the keyboard, the processor causes an error message to be displayed to the driver in order to prompt him to re-attempt to enter a valid command sequence. A corresponding "function execution subroutine" is then called by the processor in the course of executing the display subroutine. The function execution subroutine is executed while the command is being displayed by means of the display unit.

A function execution subroutine which performs the automatic engine starting operation is called by the processor if a start command is entered into the processor system. The automatic engine starting subroutine tests the alternator or generator output to determine if the engine is running. If the engine is not running, the processor tests the engine temperature to determine if the engine is cold, and calls an accelerator pumping subroutine if the engine temperature is below a predetermined level. After the accelerator has been "pumped" by means of an actuator controlled by the processor, the processor produces a start signal which causes the engine starter motor to be engaged, and simultaneously starts a time. If the engine does not start within a first predetermined number of seconds, the processor de-energizes the starter motor and waits for a second predetermined number of seconds and re-energizes the starter for another first predetermined number of seconds, after again pumping the accelerator if the engine is cold. If the engine does not start after four such attempts, the processor jumps to an error display routine. If the engine starts during any of the attempts, the processor immediately turns off the timer and disengages the starter motor.

If the driver enters a command to "roll up" or raise a window of the automobile, a "window up" display subroutine is called by the processor, and a corresponding function execution subroutine is also called by the processor. The processor then tests a position status switch to determine if the window is already "up", and exits from that function execution subroutine if the window is already"up". If the window is not "up", the processor starts a timer and sends a control signal to a window motor control relay, causing the window motor to be energized and begin raising the window. The processor repetitively tests the position status switch and turns off the window motor if a "window up" status signal is received from the position status switch. If a "window up" status signal is detected within a predetermined time, the timer is stopped and the window motor is de-energized. However, if a "window up" status signal is not detected within such predetermined time, the processor is interrupted by the timer. The timer is then stopped, the window motor is de-energized, and an error display subroutine is called by the processor. Thus, the window motor is turned off even if the position status switch fails or if the window jams or if the window motor is unable to raise the window for some other reason. Thus, excessive current drain on the automobile battery is avoided if the system fails to operate properly.

Additional display subroutines and corresponding function execution subroutines for controlling the door locks, trunk lock, air conditioning system, heating system, headlights, and radio antenna are also included in the processor.

BRIEF DESCRIPTION OF THE DRAWINGS

FIG. 2B discloses a block diagram of keyboard and display interface circuit 29 of FIG. 2.

FIGS. 6A and 6B constitute a partial schematic block diagram of the remote control circuitry of the system of FIG. 1.

DESCRIPTION OF THE INVENTION

Figure 1:
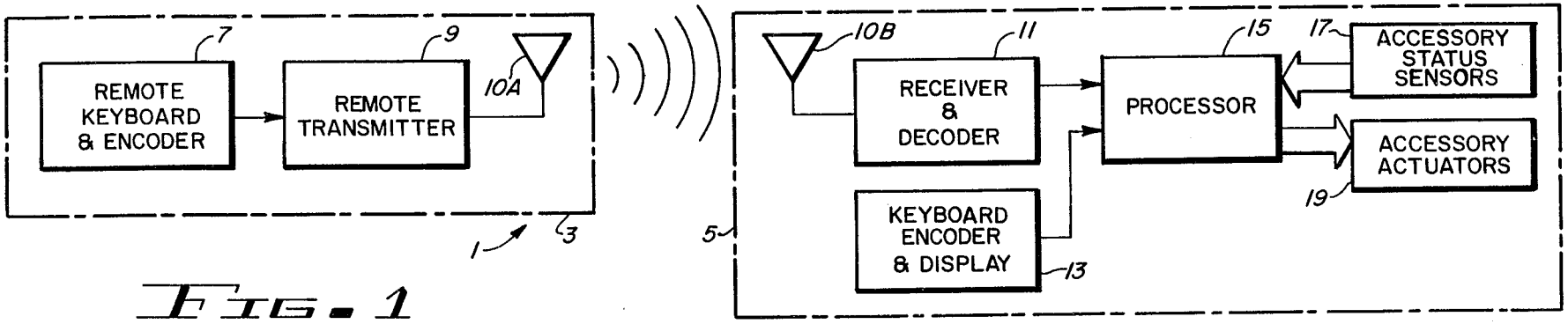
FIG. 1 is a block diagram illustrating an automotive starting and accessory control system including a remote control unit and a local control unit.

FIG. 1 shows a system 1 including a remote control unit 3 and an automotive starting and accessory control system 5 contained in an automobile. Remote control unit 3 includes a remote keyboard unit 7 which includes both a keyboard and a keyboard encoder. The keyboard encoder portion of remote keyboard unit 7 includes circuitry for producing a serial digital signal representing commands entered via the keyboard of keyboard unit 7. The serial digital signal is inputted to remote transmitter 9, which modulates the radio frequency carrier signal radiated by the antenna of remote transmitter 9 in accordance with information contained in the serial digital signal. The transmitted radio signals are received by the antenna of a receiver and decoder unit 11 contained in starting and accessory control system 5. Receiver and decoder unit 11 includes a radio receiver which detects the serial digital information contained in the radio frequency signal received, and converts the serial digital information to a parallel format which is provided as an input to processor 15. Identical information can be entered into starting and accessory control system 1 by means of local keyboard and encoder unit 13. Keyboard and encoder unit 13 includes a keyboard identical to the keyboard included in remote keyboard and encoder unit 7, and the same commands can be entered via either keyboard, decoded, and provided as inputs to processor 15. Processor 15 stores an operating algorithm, subsequently discussed, which executes the received command, and accordingly determines the status of various accessory status sensors 17 and produces predetermined output signals necessary to actuate various accessory actuators 19 included in the automobile.

Figure 4:
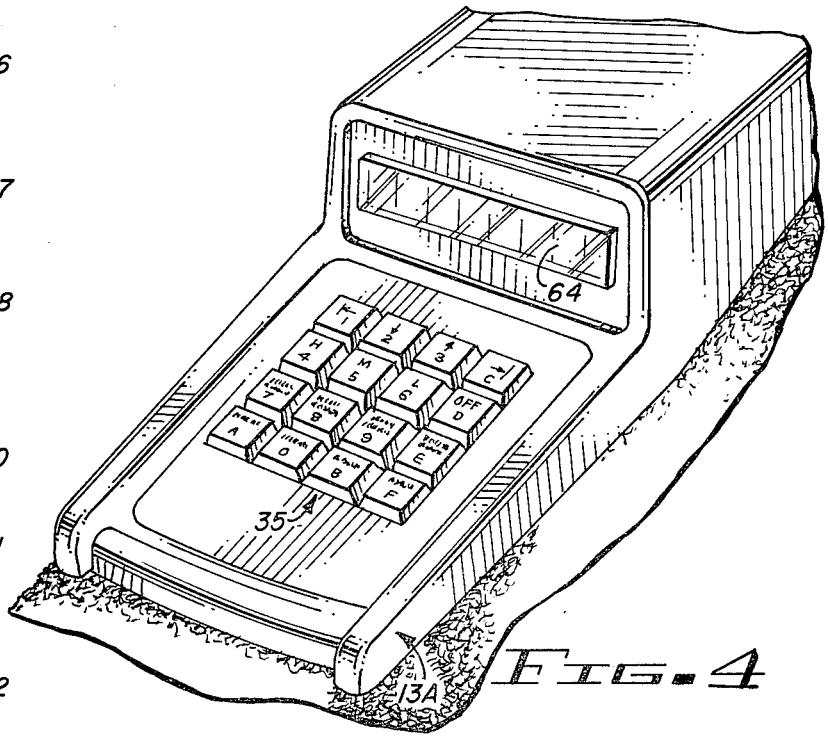
FIG. 4 is a perspective diagram of the keyboard and display console for the system of FIG. 1 installed in the driver's compartment of an automobile.

The keyboard and display portion of keyboard, encoder and display block 13 of FIG. 1 can be mounted in the driver's compartment of an automobile, as shown in FIG. 4. Referring to FIG. 4, keyboard and display unit 13A includes keyboard 35 and display 64. Of course, either keyboard 35 and/or display 64 could readily be mounted on the dash of an automobile, rather than as a console as shown in FIG. 4.

Figure 5:
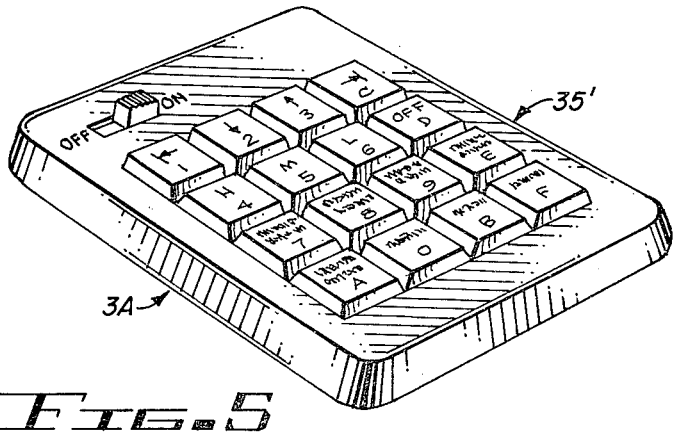
FIG. 5 discloses a remote control console having a keyboard identical to the keyboard of the system of FIG. 2.

Referring now to FIG. 5, the remote keyboard, encoder, and transmitter unit 3 of FIG. 1 can be embodied in a small, thin pocket-size unit 3A which includes a power ON/OFF switch and a 4×4 array of flat flex-disc type switches or other types of micro-switches. The antenna is "built-in," and can be completely contained within the housing, or can be extendible to provide greater range and directionality.

Figure 2A:
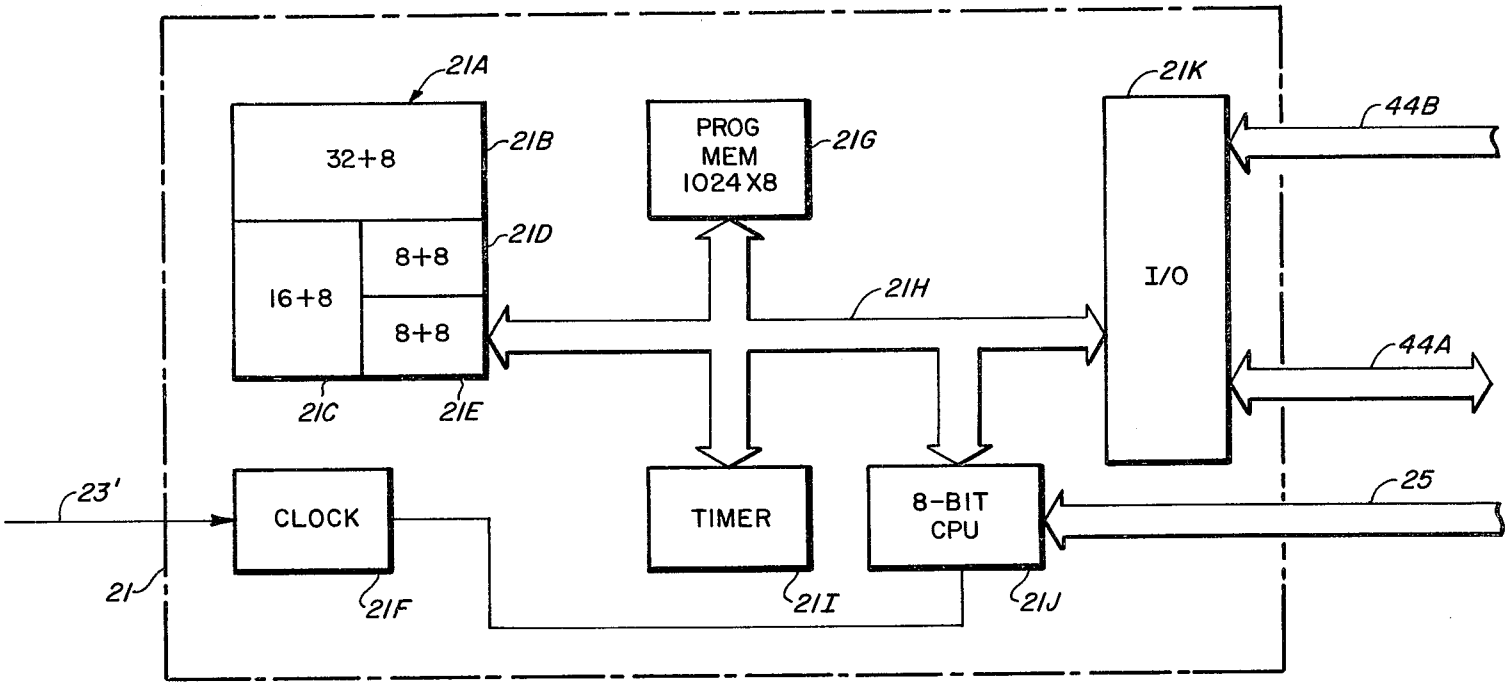
FIG. 2A discloses a block diagram of microprocessor 21 of FIG. 2.
Figure 2:
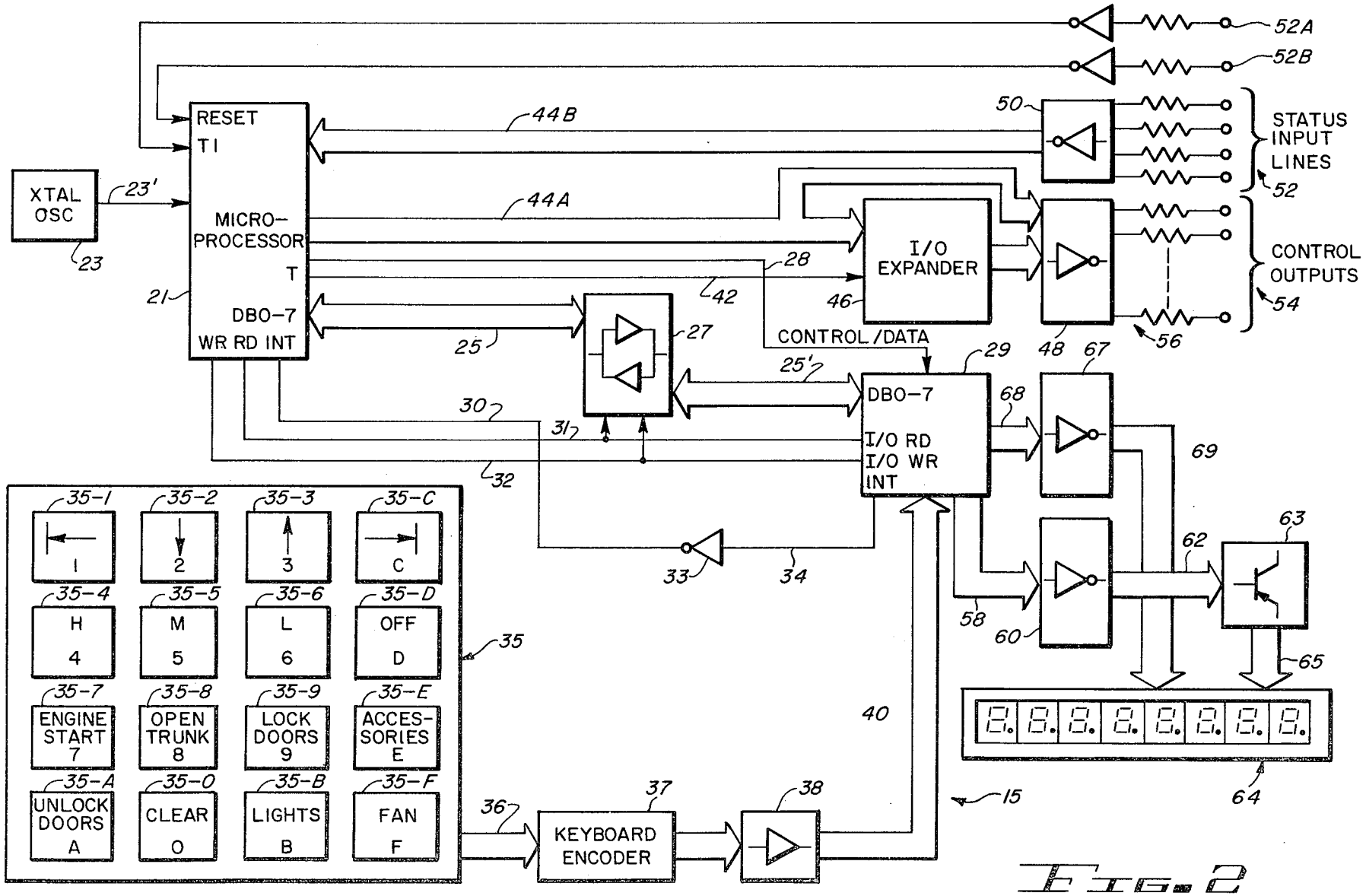
FIG. 2 discloses a detailed block diagram of the processor system of FIG. 1.

Referring now to FIG. 2, processor 15 includes microprocessor 21, which is implemented utilizing an Intel 8748 microprocessor. Referring to FIGS. 2 and 2A, the Intel 8748 microprocessor includes an internal eight bit central processor unit (CPU) designated by reference numeral 21J. Central processor unit 21J is a classical data processing machine including a plurality of working registers, a program counter, an arithmetic and logic unit, and one or more accumulators, all coupled to an internal data bus 21H. The internal architecture can be similar to that of an Intel 8080 eight bit microprocessor or a Motorola MC 6800 eight bit microprocessor, both of which are widely known in the industry. U.S. Pat. No. 3,962,682 by Bennett, issued June 8, 1976 is incorporated by reference herein to show details of one embodiment which may be utilized to implement the eight bit central processor unit 21J of FIG. 2. Details of the Intel 8748 single component eight bit microcomputer used in the presently preferred embodiment of the invention are set forth in a "MSC-48*TM* Microcomputer User's Manual," copyright 1978, by the Intel Corporation, and incorporated herein by reference to show details of microprocessor 21, I/O expander 46, and keyboad and display interface circuit 29. Microprocessor 21 also includes a 1024 word by eight bit program memory 21G and a 64 word by weight bit data memory 21A. Data memory 21a has 32 words for data storage, 16 words utilized as a word processor stack 21C, an 8 word register bank 21D, hereinafter referred to as register bank 0, and an 8 word register bank 21E, hereinafter referred to as register bank 1. An eight bit program controllable timer/counter 21I is also connected to bidirectional data bus 21H.

Referring to FIG. 2, crystal oscillator 23 provides a clock signal input to microprocessor 21 via conductor 23'. Microprocessor 21 is connected to a keyboard and display interface circuit 29 by means of a bidirectional data bus 25, bidirectional buffer circuitry 27, and bidirectional data bus 25'.

Keyboard and display interface circuit 29 is implemented utilizing an Intel 8729 programmable keyboard-/display interface integrated circuit. Referring now to both FIGS. 2 and 2B, keyboard and display interface circuit 29 includes a FIFO (a first in, first out) memory 29C coupled to bidirectional data bus 25' by means of internal data bus 25" and a set of data buffers. Keyboard and display interface circuit 29 also includes scan circuitry 29B connected to bus 58 for automatically sequentially energizing the control inputs of light emitting diode display 64 so that display information written into display RAM 29A is continually automatically displayed and refreshed on the individual elements of display 64. Keyboard and display interface circuit 29 also includes a status circuit 29F which produces an interrupt signal on conductor 34 if any information loaded into FIFO memory 29C from keyboad 35 has not been "read" by microprocessor 21 by means of a data bus 25, 25', and the read control input RD of FIG. 2B.

Bus 58 of FIG. 2 includes a plurality of conductors which are inputted to buffer circuit 60. Buffer circuitry 60 can be implemented utilizing the Texas Instruments 7442 BCD to decimal decoder. The outputs of the individual driver circuits of driver circuitry 60 are connected by means of conductors of bus 62 to the base electrodes of a plurality of transistors generally indicated by reference numeral 63. The emitters of transistors 63, which are NPN transistors, are connected to the +5 volt power supply, and the respective collectors are connected to the element select or strobe inputs of the respective light emitting diode elements of display unit 64. Display 64 includes eight five-segment displays, which are widely available. Signals are applied to the conductors of bus 58 by keyboard and display interface circuit 29 in a sequential and repetitive fashion to automatically "refresh" display unit 64.

Eight outputs of keyboard and display interface circuit 28 are coupled by means of eight conductors designated by reference numeral 68 to the respective inputs of eight inverter/driver circuits generally designated by reference numeral 67. The outputs of inverter/driver circuits 67 are connected by means of eight conductors designated by reference numeral 69 to the respective segment selection inputs of each of the eight display elements included in display 64. The conductors designated by reference numerals 58 and 68 are internally coupled to the outputs of scan counter 29B in keyboard and display interface circuit 29.

Keyboard and display interface circuit 29 has an interrupt output connected to FIFO memory 29C. The interrupt output 34 is connected to the input of inverter 33, which produces an interrupt signal on conductor 30. Any time that a word corresponding to depression of a key of keyboard 35 is entered into FIFO memory via conductors 40, an interrupt signal is produced on interrupt conductor 34. A corresponding signal is produced on conductor 30, which is connected to the interrupt input of microprocessor 21. This signal causes the algorithm stored in microprocessor 21 to "vector" to the keyboard interrupt service routine shown in the flow diagram of FIG. 7B and discussed subsequently herein.

Still referring to FIG. 2, keyboard 35 drives keyboard encoder 37 by means of four column conductors and four row conductors, which in combination are generally designated by reference numeral 36. The output produced by keyboard encoder 37 contains an encoded command signal code that corresponds to the particular one of the keys of keyboard 35 which was depressed and a strobe signal. The encoded command signals and the strobe signal are transmitted from keyboard encoder 37 to keyboard and display interface circuit 29 by means of inverters in circuitry 38 and corresponding conductors in bus 40. The strobe signal performs the function of strobing the four bit code into the next available bit of FIFO memory 29C in keyboard display interface circuit 29. Keyboard encoder 37 can be readily implemented by means of a Motorola MC14419 keyboard encoder and a conventional "debounce" circuit which may be readily implemented by those skilled in the art.

Still referring to keyboard 35 of FIG. 2, keys 35-1, 35-C, 35-2, and 35-3 are utilized, respectively, to enter commands instructing microprocessor 21 to select a left window of the automobile, select the right window, open the selected window, and close the selected window. Keys 35-4, 35-5, and 35-6 are utilized, respectively, to set the fan speed of the air conditioning/heating system to the high, medium, and low speed settings. Key 35-D is utilized to enter commands causing the automobile engine and various accessories to be turned off. Key 35-7 is utilized to enter a command causing an automatic engine starting subroutine, shown in FIG. 7I, to be executed. Key 35-8 is utilized to enter a command causing the trunk of the automobile to be unlocked. Key 35-9 is utilized to enter a command which causes all of the doors of the automobile to be locked. Key 35-E is utilized to enter commands to control the ignition switch of the automobile. Key 35-A is used to enter a command causing the car doors to be unlocked. Key 35-0 is used to enter a "clear" command signal which is necessary for every valid command. Key 35-B is used to enter a command which causes the headlights of the automobile to be turned on. Key 35-F enters a command which turns the fan motor off for the heating/air conditioning system. The valid command key depression sequence required for various commands of the system of FIG. 1 is shown in Table 1.

TABLE 1

| Command | Key Depression Sequence |
|---|---|
| Left Window-Up | 0,1,3 |
| Left Window-Down | 0,1,2 |
| Right Window-Up | 0,C,3 |
| Right Window-Down | 0,C,2 |
| Fan-High | 0,F,4 |
| Fan-Med | 0,F,5 |
| Fan-Low | 0,F,6 |
| Fan-Off | 0,F,D |
| Lights-High | 0,B,4 |
| Lights-Med | 0,B,5 |
| Lights-Low | 0,B,6 |
| Lights-Off | 0,B,D |
| Lock Doors-Lock Doors | 0,9,9 |
| Unlock Doors-Unlock Doors | 0,A,A |
| Open Trunk-Up | 0,8,3 |
| Ignition On | |
| Car On-Car On | 0,E,E |
| Electrical System Off | 0,E,D |
| Master Off (Turns off engine, locks doors, rolls up windows, waits 35 seconds, then turns off headlights and electrical system) | 0,D,D |
| Engine Start | 0,7,7 |

As shown in Table 1, a valid command key depression sequence always requires that the "clear" key (i.e., key 0) be depressed first, followed by sequential depression of two command keys. The operating algorithm tests the key depression sequence to determine if a valid command is being entered and then performs a table look-up and compare operation to determine which command was entered, as subsequently explained.

Microprocessor 21 includes a plurality of programmable ports, which can be individually programmed either as input ports or output ports. One group of such ports is connected to a group of conductors designated by reference numeral 44A. Four of the conductors of bus 44A are inputted to inputs of input/output expander circuit 46, and three conductors are connected, respectively, to inputs of individual inverter circuits included in buffer circuitry 48.

Input/output expander circuit 46 is shown in more detail in the above-mentioned Intel Corporation publication incorporated herein by reference and includes a plurality of outputs each connected to additional inputs of inverters included in buffer circuitry 48. The outputs of all of the inverters in buffer circuitry 48 are coupled by means of resistors (generally designated by reference numeral 56) to respective control outputs generally designated by reference numeral 54. The control outputs 54 are individually connected to various relays and switches (shown in FIG. 3) in the automotive electrical system. The values of resistors 56 are selected to control the magnitude of the circuit signals which are used to actuate the various relays in FIG. 3.

Input/output expander circuit 46 can be readily implemented by means of an Intel 8243 input/output expander integrated circuit.

An additional port of microprocessor 21 is connected to conductor 28, which is inputted to an input of keyboard and display control circuit 29 to determine whether data on data bus 25, 25' is control information or data information.

Conductors 44B are connected to additional ports of microprocessor 21, which additional ports are programmed as input ports. Conductors 44B are connected to outputs of inverters contained in buffer circuitry 50. The inputs of the inverters contained in buffer circuitry 50 are coupled by means of individual ones of the resistors generally designated by reference numeral 56 to respective ones of status inputs 52. Status inputs 52 are connected to various status switches shown in FIG. 3 and described in detail hereinafter.

Figure 3:
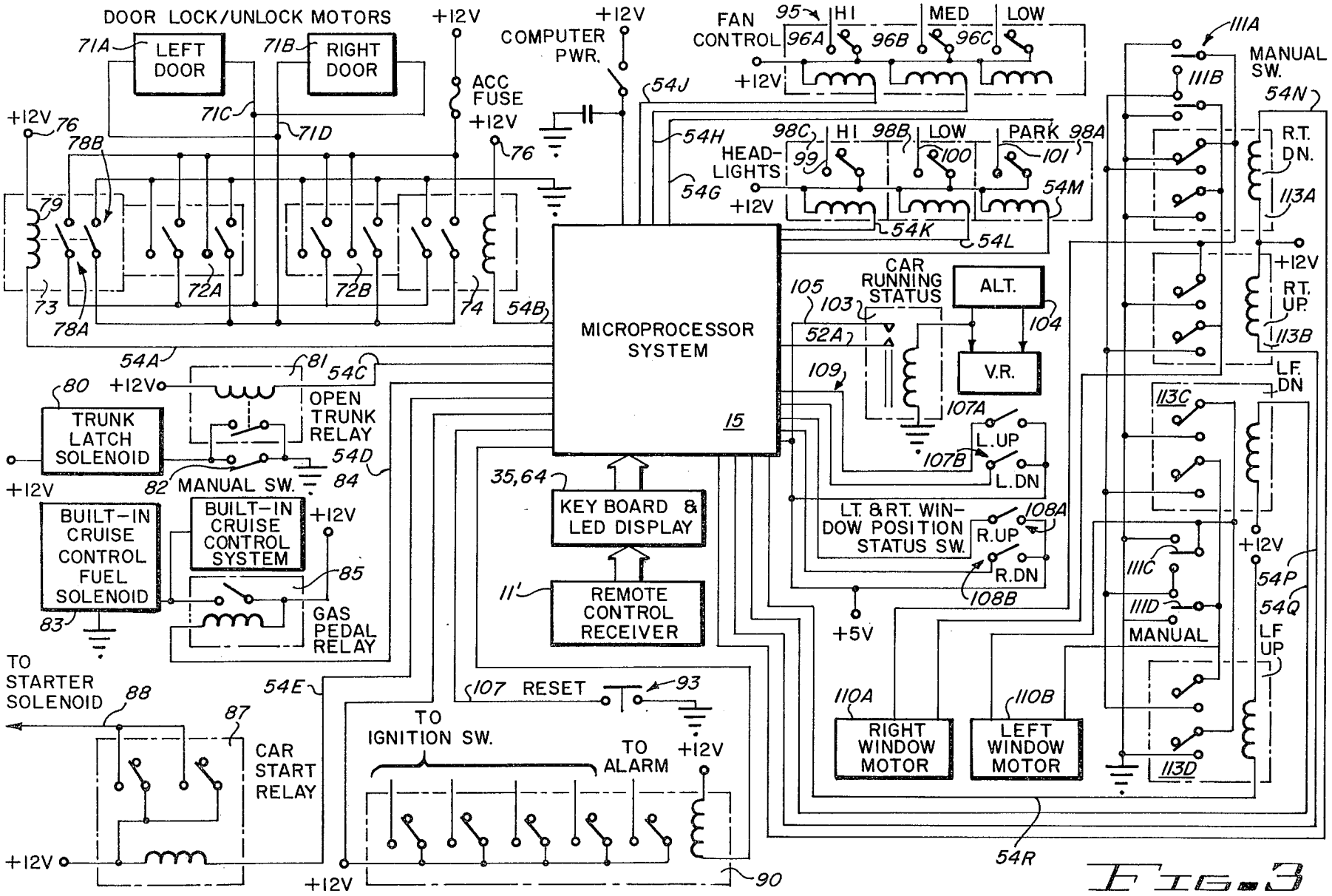
FIG. 3 is a diagram illustrating connection of the processor system of FIG. 2 in an automotive electrical system.

A timing input of microprocessor 21 is connected to input 52A, which is directly connected to the engine status relay 103 of FIG. 3 to indicate if the engine is running.

Referring now to FIG. 3, microprocessor system 15 of FIG. 2 produces control signals in the course of executing the stored operating algorithm for controlling various relays. Microprocessor system 15 also senses signals from various status switches in the automobile electrical system. The automobile electrical system includes motors 71A and 71B for locking and unlocking the left door and the right door of the automobile, respectively. (The described embodiment of the invention is installed in a two-door luxury sedan. However, as will be readily apparent to those skilled in the art, only slight modifications would be necessary to implement the system of the present invention in a four-door sedan.) Door lock/unlock motors 71A and 71B are each connected to conductors 71C and 71D. If conductor 71C is energized, the door lock/unlock motors 71A and 71B are both operated to lock the doors of the automobile. Alternatively, if conductor 71D is energized, motors 71A and 71B operate to unlock the doors. If microprocessor system 15 produces a control current signal in conductor 54B, lock relay 74 is activated and couples conductor 71C to the +12 volt conductor and also connects conductor 71D to the ground conductor, thereby causing the doors to be locked. However, if a control current signal is produced in output 54A by microprocessor system 15, conductor 74B is connected by means of switches 78A and 78B to the +12 volt conductor 76 and the ground conductors, respectively, in response to relay coil 79 of unlock relay 73, and motors 71A and 71B are energized to unlock the doors of the car.

Still referring to FIG. 3, reference numerals 72A and 72B illustrate manual switches connected in parallel with relays 73 and 74 to accomplish manual locking or unlocking of the car doors.

Microprocessor system 15 is connected to a trunk latch solenoid 80 by means of relay 81 and control conductor 54C. When an appropriate current pulse is produced in control conductor 54C by microprocessor system 15 in response to an "open trunk" command entered by means of key 35-8 (See FIG. 2), relay 81 is energized. Relay 81 then energizes trunk light solenoid 80. Manual switch 82 is connected in parallel with relay 81 to permit manual opening of the trunk latch solenoid.

Microprocessor system 15 is coupled to gas pedal (accelerator) relay 85 by means of control conductor 54D. In the illustrated embodiment of the invention, gas pedal relay 85 is incorporated in cruise control system 84. For a vehicle without a built-in cruise control system, gas pedal relay 85 and a corresponding gas pedal solenoid can be installed.

Microprocessor system 15 is coupled to the automobile's starter motor solenoid by means of car start relay 87 and control conductor 54E; car start relay 87 is acutated by a control current signal produced in conductor 54E by microprocessor system 15.

A manual reset switch 93 applies a ground voltage to the rest input of microprocessor system 15 to reset microprocessor system 15.

Microprocessor system 15 is coupled to three fan control relays, which are collectively designated by reference numeral 95, by control conductors 54G, 54H, and 54J to control three fan speed control switches, which respectively select the high, medium, and low fan speeds of the fan control motor.

Headlight control relays 98A, 98B, and 98C are coupled to microprocessor system 15 by means of control conductors 54M, 54L, and 54K, respectively.

Microprocessor system 15 determines if the automobile engine is running by checking or testing the status of relay 103. Relay 103 is energized by the alternator output if the engine is running, thereby producing an engine status signal on conductor 54A. The engine status signal is then sensed by microprocessor system 15.

Microprocessor system 15 is coupled to the right window motor 110A by means of control relays 113A and 113B and control conductors 54N and 54P, respectively. Microprocessor system 15 is connected to left window motor 110B by means of control conductors 54R and 54Q and control relays 113C and 113D. Manual switches 111A and 111B control the right window "in parallel" with control relays 113A and 113B; similarly, manual switches 111C and 111D control the left window in parallel with control relays 113C and 113D.

Microprocessor system 15 senses the window status (completely open or completely closed) by means of conductors 109 connected to window status switches 107A, 107B, 108A, and 108B. The status (open or closed) of window status switches 107A and 107B indicate whether the left window is completely open or closed. Similarly, the status of window status switches 108A and 108B indicate if the right window is completely open or closed.

FIG. 6A shows a schematic datagram of remote console unit 3. Remote keyboard, encoder, and transmitter unit 3' includes 4×4 keyboard 35' connected by means of eight conductors, generally designated by reference numeral 9B, to dual tone multi-frequency generator touch tone generator 9A. Dual tone multi-frequency generator 9A can be readily implemented utilizing a Model AY-3-9410 dual tone multi-frequency touch tone generator manufactured by General Instruments Corporation. A frequency Reference circuit 9E, which may be a crystal oscillator or a low-cost ceramic resonator, is connected to the frequency control inputs of dual tone multi-frequency generator 9A. This circuit is capable of generating all "tone pair" signals on output 9F required for multi-frequency tone dialing. Output 9E is connected to the input of a driver circuit 9C, which may be a junction field effect transistor driver circuit. The output of driver 9C is connected to a modulation input of an RF oscillator circuit 9D, which can include a bipolar transistor having its base electrode connected to the output of driver 9C, its emitter electrode connected by means of capacitor 9K to ground, and its collector electrode connected to the input of an RF amplifier circuit 9J having its output connected to transmitter 10A. A crystal 9H is operatively connected to RF oscillator 9D to establish a radio frequency signal. Thus, the transmitted signal from antenna 10A is an RF signal modulated by the two audio tone frequencies which collectively represent the depressed key of keyboard 35'.

A block schematic diagram of the receiver and decoder 11 is shown in FIG. 1 as set forth in FIG. 6B. The "tone-modulated" RF signal receiver from remote transmitter 9 and antenna 10A is receiver by receiver antenna 10B, which is connected to a resonant circuit 11A. The output of resonant circuit 11A is connected to an input over RF amplifier 11B. RF amplifier 11B can be readily provided by those skilled in the art, and may consist of a single transistor RF amplifier with appropriate biasing circuitry. The output of RF amplifier 11B is connected to an input of a mixer circuit 11C, which performs the function of separating the two tone frequencies from the carrier. Circuitry to perform this function is also well known to those skilled in the art. A local oscillator 11D has an output connected to an input of mixer 11C. The output of mixer 11C is provided as an input to an ordinary intermediate frequency amplifier 11F. The output of intermediate amplifier 11F is coupled by means of isolation transformer 11G to an amplitude modulation detector represented by diode 11H. The output of amplitude modulation detector 11H is inputted to a dual operational amplifier notch filter 11I, which performs the function of eliminating upper band to lower band ambiguities resulting from transmission phase distortion. The output of notch filter 11I contains a dual tone signal coupled to the input of a circuit 11J, which includes "high group" band test filter amplifier circuitry 11K and "low group" bandpass filter amplifier circuitry 11L. The outputs of bandpass filter amplifier circuitry 11K and 11L is inputted to control and decode logic circuitry 11M, which provides outputs which are logically "ORed" to the four bit binary data "nibble" conductors of bus 40 and a strobe signal conductor included in bus 40. The four bit binary data nibble conductors are represented in FIG. 6B by reference numeral 40', and the strobe conductor is represented by reference numeral 40''. Circuitry 11J can be readily implemented by means of a Model Ay-5-9805 dual tone multi-frequency receiver integrated circuit manufactured by General Instruments Corporation.

Figure 7E:
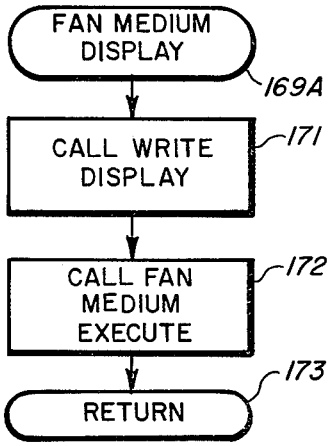
FIGS. 7A–7J constitute a partial flow diagram of the operating algorithm of the automotive starting and accessory control system of FIG. 1.
Figure 7H:
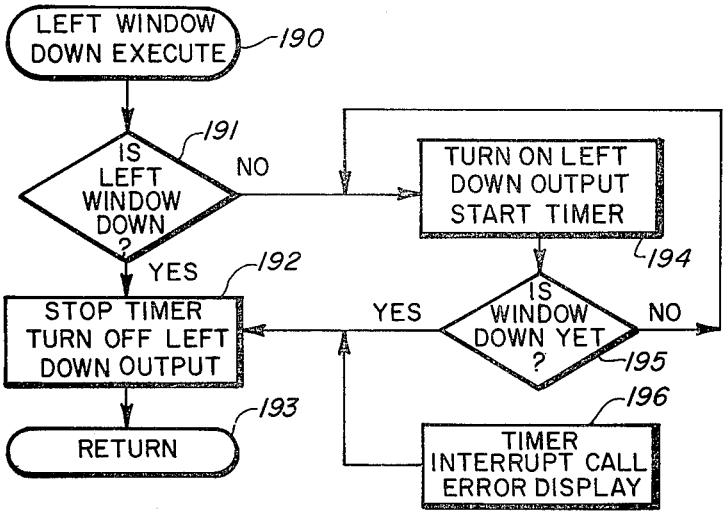
Figure 7F:
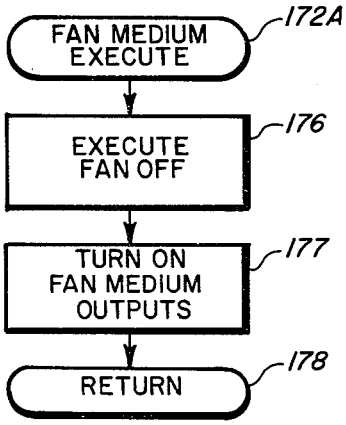
Figure 7G:
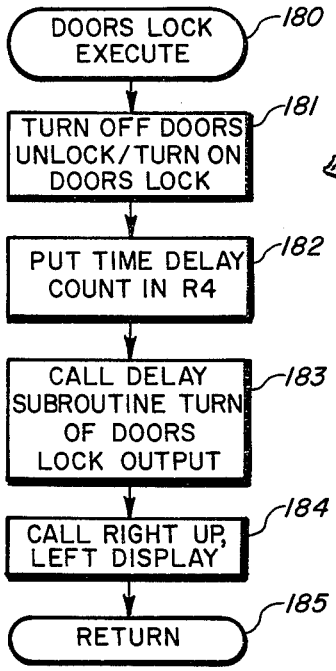
Figure 7A:
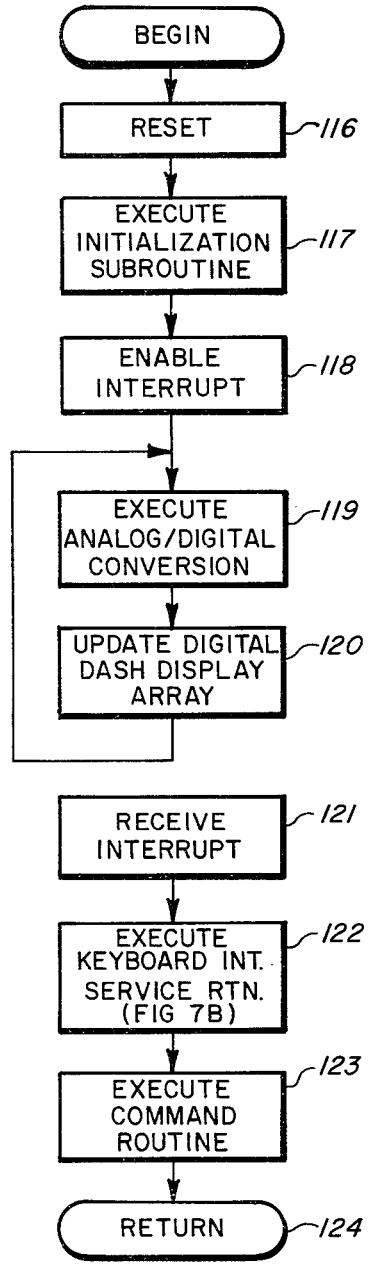

The basic structure of the operating algorithm stored in microprocessor system 15 is shown in the flow diagram of FIG. 7A. To begin operation, the reset input of microprocessor 21 (FIG. 2) is actuated, as indicated by block 116. This causes microprocessor system 15 to execute an initializing subroutine, as indicated by block 117. During initialization, microprocessor executes a subroutine which presets the various ports of microprocessor 21 to function as either inputs or outputs. Both working register Banks 0 and Bank 1 in the random access memory portion of microprocessor 21 are cleared. The internal program controlled clock divider circuit of keyboard and interface control circuit 29 is set. Display unit 64 is cleared, and FIFO memory 29C is cleared. Three control registers in keyboard and display control circuit 29 are initialized. Finally, a display subroutine is accessed and executed to cause a word such as "HELLO" to be displayed on display unit 64. A flip flop (not shown) internal to microprocessor 21 is also preset to "enable" an interrupt signal from keyboard and display interface circuit 29 when one or more bytes of keyboard information is temporarily stored in FIFO memory 29C. (As soon as each location of FIFO memory 29C is "read" by microprocessor 21, that byte of information is no longer stored).

When an interrupt is "enabled," microprocessor 21 is then able to receive a keyboard interrupt, as indicated by block 121. When a keyboard interrupt signal is received on conductor 30 by microprocessor 21, the operating algorithm of FIGS. 7A-7I executes a keyboard interrupt service routine, shown in FIG. 7B, and accordingly executes the appropriate command routine, as indicated by block 123, and returns to the main algorithm, as indicated by label 124.

The above-mentioned display subroutine prepares keyboard and display interface circuit 29 to operate in an "update display mode." A logical "1" is applied to control/data conductor 28 of FIG. 2 so that the next byte on data bus 25 is interpreted as control information which is loaded into a control register of keyboard and display interface circuit 29 and causes subsequent bytes received via data bus 25' to be interpreted as display data, which is automatically displayed on display unit 64.

Blocks 119 and 120 of FIG. 7A briefly describe execution of a digital dash display system. The details of the digital dash display array are not set forth herein because they are not essential to the understanding and practice of the automatic starting and accessory control system of the present invention. Blocks 122 and 123 are shown in FIG. 7A merely to illustrate that microprocessor system 15 can execute other tasks while awaiting entry of commands from keybord 35 of FIG. 2.

As previously mentioned, when one of the keys of keyboard 35 of FIG. 2 is depressed, a corresponding encoded signal is inputted into FIFO memory 29C of keyboard and display interface circuit 29. This causes an interrupt signal to be transmitted to microprocessor 21 via conductor 34, inverter 33, and conductor 30. This in turn causes microprocessor 21 to automatically load a "vector address" to a memory location "3" into the program counter (not shown) of microprocessor 21.

Figure 7B:
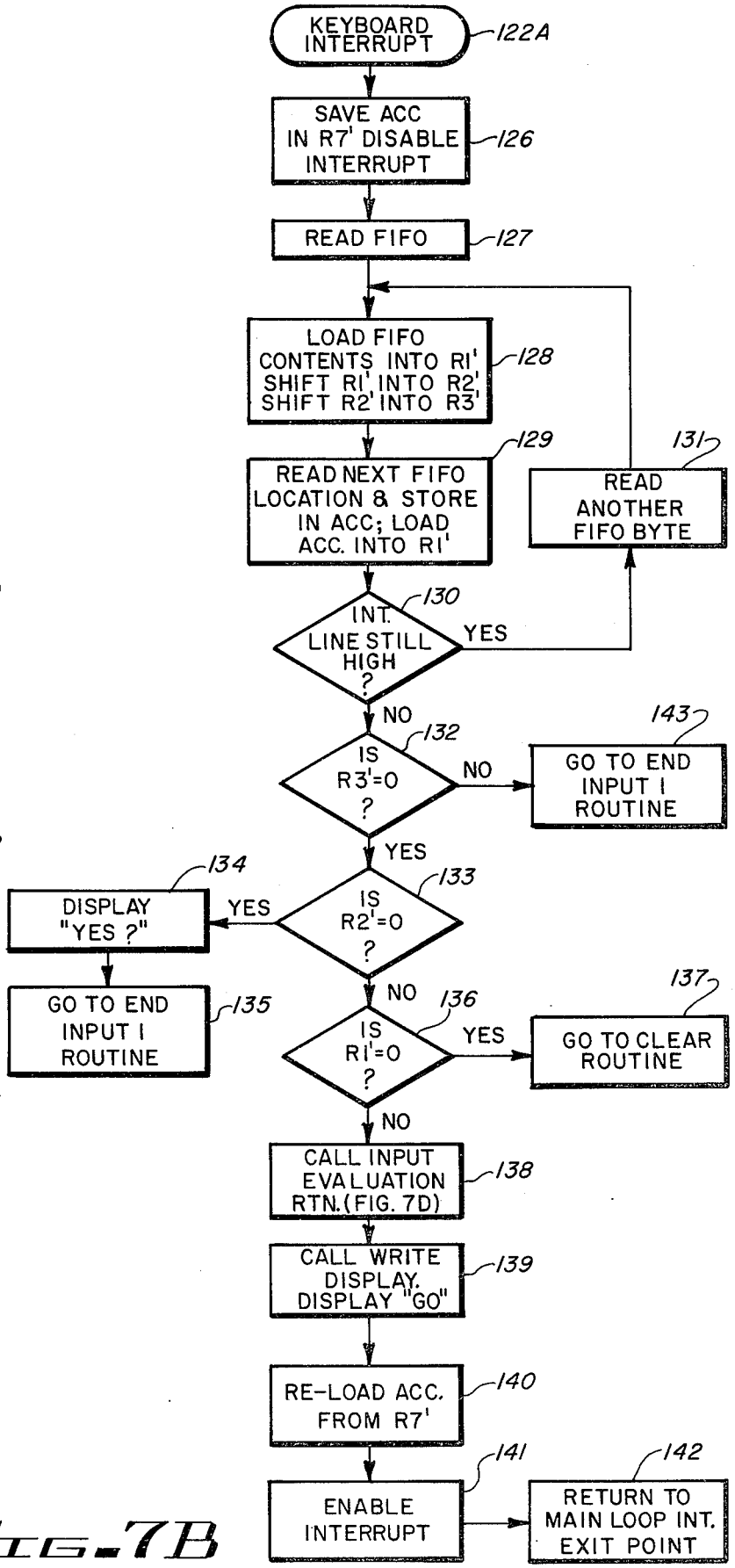

The keyboard interrupt and service routine 122 of FIG. 7A is shown in detail in FIG. 7B. The algorithm jumps to label 122A and saves the present accumulator contents in register R7′ (register 7 of memory bank 1—the "primes" herein refer to register bank 1; the "unprimed" registers are contained in register band 0) of the memory of microprocessor 21 and disables the interrupt input of microprocessor 21, as indicated by block 126. Next, the algorithm causes FIFO memory 29C of keyboard and display interface circuit 29 to be accessed and "read" by microprocessor 21.

In block 128, the byte "read" from the next FIFO memory location is loaded into R1′. The contents of R1′ are shifted to R2′, and the contents of R2′ are shifted to R3′ (the contents of R3′ are lost). If interrupt line 30 is still high, indicating presence of another keyboard byte in FIFO memory 29C, that byte is read and loaded into R1′, and the above shifting again occurs, as indicated by decision block 130 and blocks 131, 128 and 129. When a location of FIFO memory 29C is read, the contents of that location are stored in the accumulator of microprocessor 21, and the accumulator contents are then loaded into R1′, as indicated in block 29. In decision block 130, the algorithm tests the interrupt flag (which is stored in the above-mentioned internal flip flop of microprocessor 21) to determine if the signal on conductor 30 is at a logical one. If the signal on conductor 30 is a logical "1", another keyboard command is stored in FIFO memory 29C, as explained above, and the algorithm "fetches" the encoded command and re-enters block 128. If interrupt line 30 is low, the algorithm tests register R3′, as indicated in decision block 132. If the contents of register R3′ are equal to zero, the algorithm enters decision block 133; if not, the algorithm goes to a first "end input" subroutine, as indicated by reference numeral 143. This causes the original accumulator contents to be vectored, "enables" the keyboard interrupt, and causes "GO" to be displayed on display unit 64.

In decision block 133, the algorithm tests register R2′. If register R2′ contains all zeroes, the algorithm causes the word "YES" to be displayed in display unit 64 and goes to a second "end input" subroutine, as indicated by blocks 134 and 135, which subroutine is similar to the first end input subroutine except that the display is not affected.

If register R2′ does not contain all zeroes, the algorithm enters decision block 136 and tests register R1′. If register R1′ contains all zeroes, the algorithm calls up the "clear" subroutine of block 137. This resets the "stack counter" and causes the encoded command signal produced in response to the next key depression to be entered (as explained above) in R1′. In other words, the key input sequence starts over.

Figure 7I:
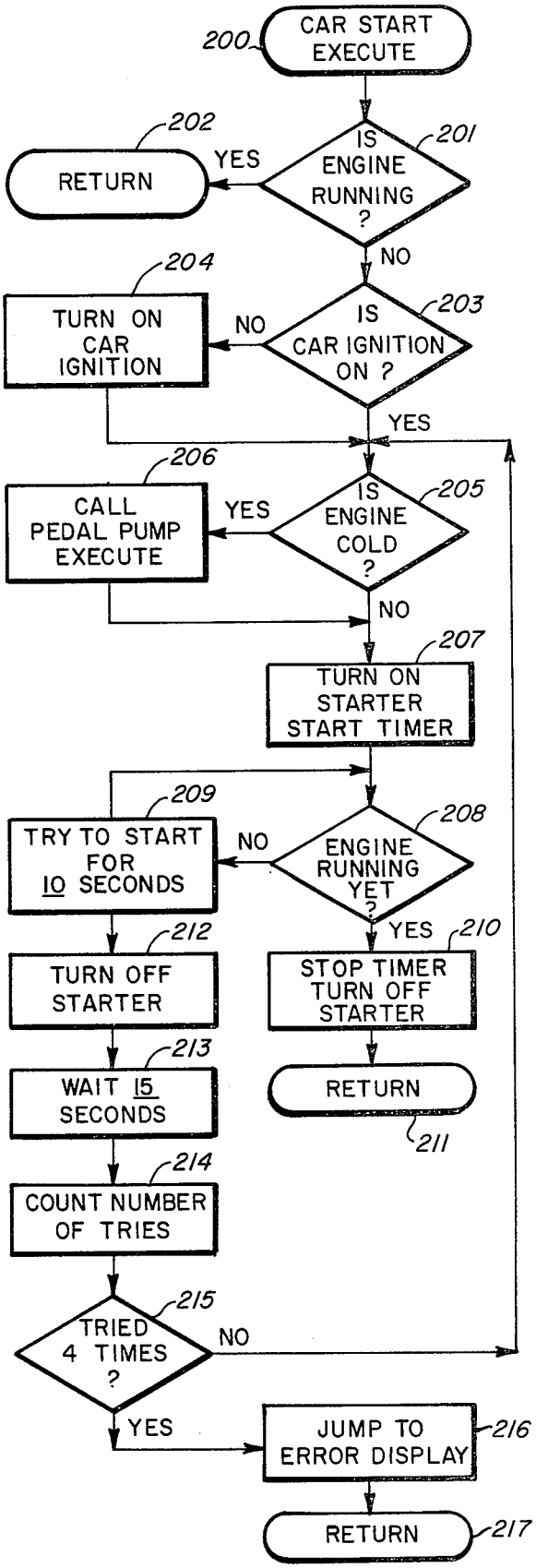
Figure 7C:
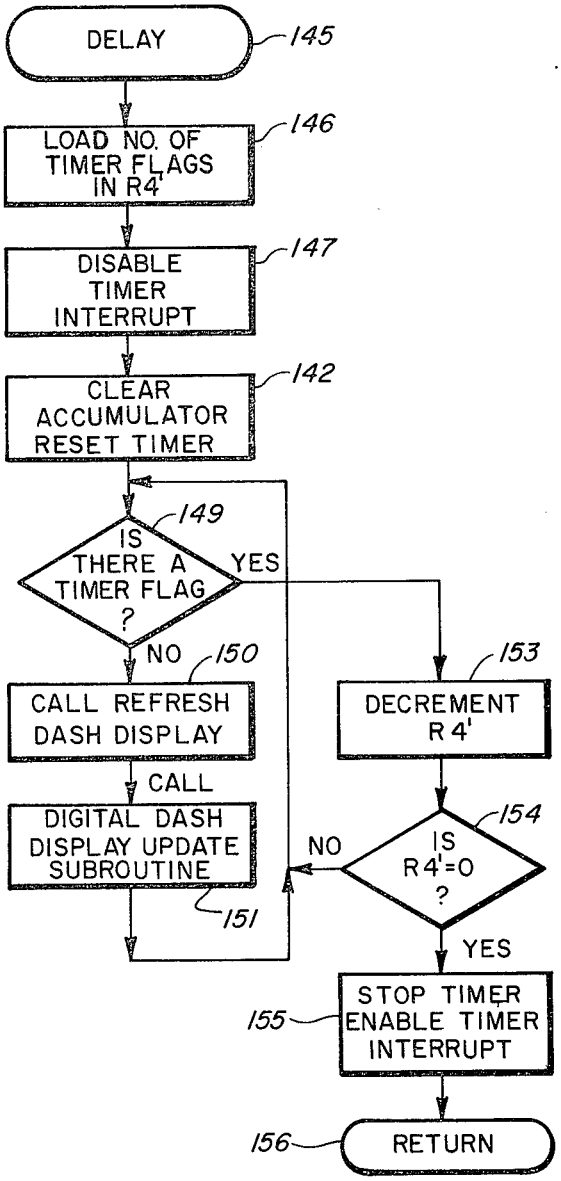
Figure 7D:
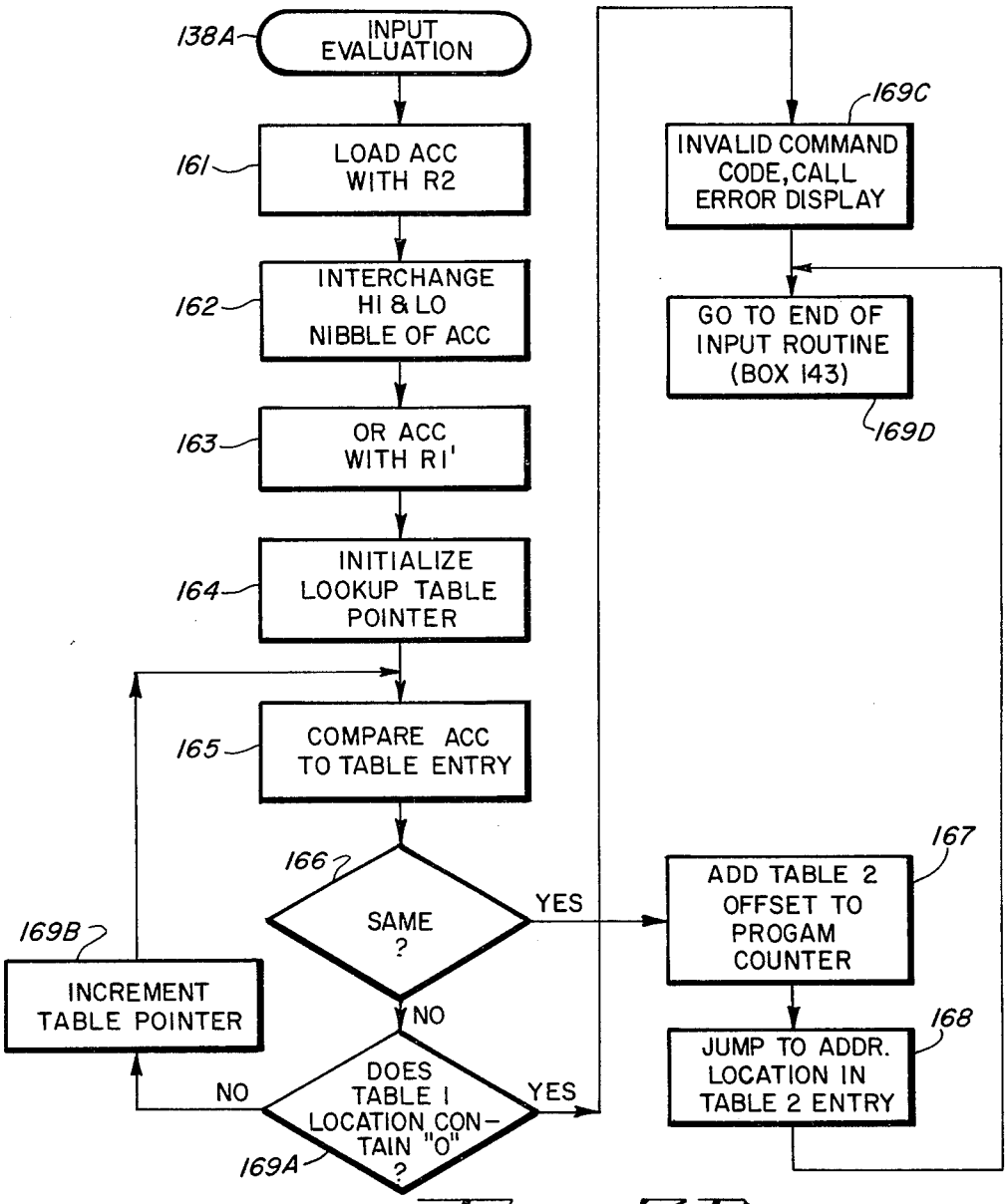
Figure 7J:
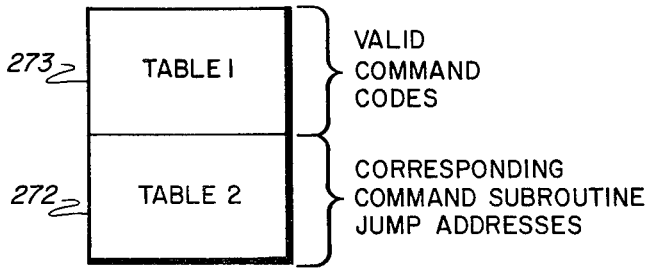

If register R1′ is not equal to zero, the algorithm calls the "input evaluation" subroutine of FIG. 7D, as indicated by reference numeral 138.

In the course of executing the input evaluation subroutine (as subsequently explained), the algorithm determines which command was entered and calls up a corresponding "display" subroutine. The display subroutine than calls up a corresponding "execution" or "function execution" subroutine. At the end of execution of the appropriate execution subroutine, the algorithm returns to the keyboard interrupt subroutine and enters block 139 thereof. The algorithm then calls up the write display subroutine, displays the word "GO" on display 64, and reloads the accumulator from register R7′, as indicated by reference numeral 140. The algorithm then enables the interrupt input of microprocessor 21 by resetting the interrupt enable flip flop thereof and then returns to the digital dash subroutine represented by reference numerals 119 and 120 of FIG. 7A.

When the keyboard interrupt subroutine of FIG. 7B jumps to the input evaluation subroutine of FIG. 7D, it enters that input evaluation subroutine at label 138A and loads the contents of register R2′ in the accumulator of microprocessor 21.

Referring now to FIG. 7D, the algorithm enters the input evaluation subroutine at label 138A. At this point, a valid sequence of key commands has been entered, and registers R1′ and and R2′ of register Bank 1 contain encoded command signals which collectively represent a valid command. The algorithm then loads the accumulator of microprocessor 21 with the contents of register R2′, as indicated by reference numeral 161 in FIG. 7D. For example, if keys 35F and 35-5 were sequentially depressed, register R2′ would contain logical zeroes in its most significant "nibble" and a hexidecimal F in its least significant "nibble"; register R1′ would contain logical zeroes and a binary 3 in its most significant "nibble" and least significant "nibble," respectively. The algorithm then interchanges the least significant nibble and most significant nibble of the accumulator, as indicated by reference numeral 162. In the above example, this causes the number "FO" to appear in the accumulator. This number is logically "ORed" with the contents of register R1′. As indicated by reference numeral 163 in the above example, this causes the number "F5" to appear in the accumulator.

The algorithm next initializes a "lookup table pointer," which points to addresses in table 273 of FIG. 7. Table 273 contains valid command codes corresponding to the entry of valid keyboard command signals via keyboard 35 corresponding to the key depression sequences shown in Table 1. In block 165, the algorithm compares the number stored in the accumulator ("F5" in the above example) to the number stored in the lookup table pointer. If the number stored in the accumulator does not match the number in the lookup table pointer, the lookup table pointer is incremented, as indicated by decision blocks 166, 169A and 169B. The algorithm then re-enters block 165 again and compares the accumulator contents to the lookup table pointer. If the algorithm determines (in decision block 166) that the number stored in the accumulator matches the lookup table pointer, the algorithm adds an "offset" number to the program counter, as indicated in block 167. The algorithm then accesses table 272 of FIG. 7, which contains command subroutine addresses corresponding to the valid command codes in Table 273. The algorithm then jumps to the memory address location specified by the command subroutine address found in Table 272. At this point, the command sequence inputted to microprocessor system 15 has been completely evaluated, and processor system 15 then proceeds to execute the selected display subroutine and function execution subroutine corresponding (for the above example) to turning the fan on and setting the fan speed to a medium speed.

In decision block 169A, the algorithm determines whether the "Table 1" location pointed to by the lookup table pointer contains all zeroes. If it does, this indicates an invalid command code. The algorithm then terminates the input evaluation subroutine, calls an error display, and goes to the end of the input evaluation subroutine, indicated by reference numeral 143 in FIG. 7B.

The stored algorithm includes a large number of "display subroutines" and "function execute" algorithms corresponding to the various commands which can be entered into microprocessor system 15. For clarity and convenience, only the "fan medium display" subroutine is shown herein, since all of the display subroutines are quite similar. The fan medium display subroutine is shown in FIG. 7E, wherein the input evaluation subroutine jumps from block 169 of FIG. 7D to label 169A of FIG. 7E if the fan medium display subroutine happens to be the one specified by the present command. The algorithm then calls the write display subroutine, as indicated by block 171, and displays a message on display 64 indicating that the microprocessor system is executing the subroutine which sets the fan motor of the airconditioning/heating system to its medium speed. The algorithm then calls the function execute subroutine of FIG. 7F which performs the function of setting the fan speed to the medium position, as indicated in block 172 of FIG. 7E. The algorithm then returns to the main program (i.e., block 119 of FIG. 7A) indicated by label 173.

All of the other display subroutines stored in microprocessor system 15 are quite similar to the fan medium display subroutine of FIG. 7E, and therefore are not shown in the drawings. All of the other display subroutines are entered at an identifying label, call the write display subroutine, cause a message indicating the requested function to be displayed on display unit 64, calls up a corresponding function execute subroutine, and return to the main program when the function execute subroutine is completely executed by microprocessor system 15.

The fan medium execute subroutine, shown in FIG. 7F and called in accordance with decision block 172 of FIG. 7E, will not be described. The fan medium execute subroutine is entered at label 172A. The microprocessor system produces a control signal which turns the fan motor off it it is running, as indicated by block 176. Next, the microprocessor system produces a control signal on control conductor 54H (FIG. 3), as indicated in block 177. The algorithm then returns to the main program, as indicated by label 178 of FIG. 7F.

The previously mentioned automatic engine starting execution subroutine is shown in the flow chart of FIG. 7I, and is entered at label 200. The algorithm tests to determine whether the automobile engine is running, as indicated in decision block 201, by testing the status of relay 103 in FIG. 3. If the engine is running, the algorithm returns to the main program, as indicated by label 202. If the engine is not running, the algorithm enters decision block 203 and tests to determine whether the ignition switch is "on." If it is not, the algorithm turns on the automobile's ignition system, as indicated in block 204 and then enters decision block 205. If the car ignition system is already on, the algorithm directly enters decision block 205 from decision block 203 and tests the engine temperature sensor to determine if the engine is cold, i.e., if the engine temperature is below a predetermined value. If the engine is cold, the algorithm causes the microprocessor to call a "pedal pump execute subroutine" (not shown) which causes the microprocessor system to produce a control signal on conductor 54D of FIG. 3 to actuate gas pedal relay 85. The pedal pump execute subroutine can be very easily implemented by those skilled in the art, and is very similar to the door lock execute subroutine of FIG. 7G, and is therefore not set forth in detail herein.

Still referring to FIG. 7I, after the pedal pump execute subroutine has been executed, the algorithm turns on timer 21I of FIG. 2A, as indicated in block 207. If the engine is not cold, the algorithm enters block 207 directly from decision block 205, and energizes starter relay 87 of FIG. 3 by applying a control current to the relay coil of starter relay 87 by means of control conductor 54E of FIG. 3, as indicated in block 207 of FIG. 7I, thereby actuating the starter motor of the automobile engine.

Next, the algorithm enters decision block 208 to determine if the automobile engine has started as a result of the starter motor being actuated, as set forth above. If the engine is running, as determined by testing status relay 103 of FIG. 3, the algorithm stops timer 21I of FIG. 2B and turns off starter relay 87 of FIG. 3, as indicated in block 210 of FIG. 7I. The algorithm then returns to the main program, as indicated by label 211. If the algorithm determines (in decision block 208) that the car engine is not running yet, the algorithm causes the starter relay 87 of FIG. 3 to remain actuated or energized. If the engine does not start within ten seconds (or any other predetermined time period), the algorithm de-energizes the relay coil of starter relay 87, as indicated by block 213. The algorithm then causes the microprocessor system to "wait" for fifteen seconds, as indicated in block 213, and enters decision block 215, after counting the number of attempts to start the engine in response to the present start command. In decision block 215, the algorithm determines whether four attempts have been made to start the engine. If the fourth attempt to start the engine was unsuccessful, the algorithm jumps to an error display subroutine, as indicated in block 216, and displays an abort message on display 64. The algorithm then returns to the main program, as indicated by label 217. If, in decision block 215, the algorithm determines that less than four attempts have been made to start the engine, the algorithm reenters decision block 205 and re-attempts to start the engine, as explained above with reference to blocks 205 through 215.

If a valid sequence of commands has been entered via keyboard 35 to enter a "door lock" command, the algorithm calls a door lock display subroutine similar to the display subroutine of FIG. 7E, as indicated by block 138 of FIG. 7B. That door lock display routine then calls up the door lock execute subroutine of FIG. 7G, which is entered at label 180. Then the door lock execute subroutine enters block 181 and causes microprocessor system 15 to produce a control signal on conductor 54A of FIG. 3, which control signal persorms the function of actuating door lock relay 73. The door lock execute subroutine then puts a time delay count in register R4 of the memory of microprocessor 21 and then calls a "delay subroutine" (shown in FIG. 7C) which performs the function of providing a delay to allow door lock/unlock motors 71A and 71B of FIG. 3 to lock the door. As indicated in block 183, the door lock execute subroutine then calls up the display subroutine corresponding to the door lock command, which display subroutine in turn calls up the function execute subroutine which rolls the door windows up. Thus, whenever the doors are locked, the windows are automatically rolled up in the described embodiment of the invention.

The delay subroutine called in accordance with block 183 of FIG. 7G is shown in detail in FIG. 7C. The purpose of the delay subroutine is to utilize timer 21I of FIG. 2B so as to "match" the operation of high-speed microprocessor system 15 to the much slower physical action of the various actuators, such as the lock motors, window motors, starter, and gas pedal solenoid of the automobile as such actuators are controlled by microprocessor system 15. Referring now to FIG. 7C, the delay subroutine is entered at label 145. A number equal to the number of "timer flags" is loaded in register R4'. (Each time timer 21I of of FIG. 2B reaches its maximum count as it is incremented, a "timer flag" is generated.) Next, the algorithm disables the timer interrupt, as indicated in block 147. The accumulator of CPU 21J is cleared, and timer 21I is reset, as indicated in block 148. Next, the algorithm enters decision block 149 and determines if a timer flag has been set as a result of timer 21I counting past its maximum value. If so, the algorithm decrements the contents of register R4', as indicated in block 153, and tests the contents of register R4' to see if they are equal to zero, as indicated in decision block 154. If the contents of register R4' are equal to zero, the algorithm stops timer 21I, and enables the timer interrupt, and then returns to the main program, as indicated by block 155 and label 156. If the contents of register R4' are not equal to zero, the algorithm re-enters decision block 149 from decision block 154 and again tests to determine if there is a timer flag. When the timer has counted for a longer period of time to generate the number of flags initially loaded in register R4', the algorithm finally stops the timer and enables the time interrupt. If there is no timer flag, as determined in decision block 149, the algorithm calls the refresh-display subroutine and updates the dash display, as indicated by blocks 150, 151, and 152, and re-enters decision block 149.

FIG. 7H shows the function execute subroutine corresponding to an input command to lower the left windows. This subroutine is called up at label 190 from a corresponding left window down display subroutine, not shown in detail herein. The left window down execute subroutine enters decision block 191 to determine if the left window is already down. If the left window is already down, a signal from the status switch 107B of FIG. 3 is received by the microprocessor and utilized by the algorithm to stop timer 21I and ensures that a logical zero is on control conductor 54Q of FIG. 3. The algorithm then returns to the main program, as indicated by label 193. If the left window is not down, the algorithm enters block 194 and produces a logical one on conductor 54Q of FIG. 3, thereby energizing a left window motor 110B so that it rolls the left window down, as indicated in FIG. 3. The algorithm then enters decision block 195, which causes status switch 107B of FIG. 3 to be sensed to determine if the left window is down yet. If it is not, the algorithm loops back to block 194. If the left window is down, the algorithm enters block 192 and turns off the timer and produces a logical zero on conductor 54Q and returns to the main program. If the timer counts past a predetermined point, an interrupt (a software interrupt) is produced by the timer, as indicated in block 196. This causes the microprocessor system to produce an error display on display unit 64, stops the timer, and disables the output on conductor 54Q, thereby turning off left window motor 110B. This feature of the invention prevents simultaneous energization of right window motor 110A and left window motor 110B in case any of the window status relays 107A, 107B, 108A or 108B fails. This feature also prevents a window motor from being energized for a long period of time, thereby producing excessive drain on the car bettery, if a corresponding window status relay fails to indicate when a window is rolled all the way down or all the way up.

Although the invention has been described with reference to a particular embodiment thereof, those skilled in the art will recognize that variations in structure of the microprocessor system and in structure of the disclosed operating algorithm may be readily made by those skilled in the art. For example, the automatic starting algorithm of FIG. 7I may be replaced by an alternate automatic engine starting subroutine which causes the processor system to automatically attempt to start the engine four times, each attempt being conditioned on the fact that the engine is not running, instead of counting the number of attempts to start the engine and determining whether four attempts have been made, as indicated in block 214 and decision block 215 of FIG. 7I. Various alternate integrated circuit micrprocessors or microcomputers and various alternate approaches to interfacing between the display unit and the keyboard may be readily provided by those skilled in the art. Various additional accessories and accessory functions may be controlled simply by appropriately expanding the operating algorithm and providing additional appropriate sensor and control port connections for the microprocessor system. Accordingly, the scope of the invention is intended to be limited only by the following claims.

I claim:

1. A system for automatically starting an engine of an automobile in response to a start command, said system comprising in combination:

(a) command means for entering said start command into said automatic starting system;

(b) status means for producing an engine status signal if said engine is running;

(c) means responsive to a first control signal for energizing a starter motor of said automobile;

(d) first control means responsive to said command means for generating said first control signal, thereby causing said energizing means to energize said starter motor, said first control means including;

(i) means coupled to said command means for enabling said first control means to generate said first control signal in response to said start command if said engine status signal is not present;

(ii) first timing means for producing a first timing signal a first predetermined time after said first control signal is generated;

(iii) means responsive to said first timing signal and said engine status signal for stopping said first control signal, thereby de-energizing said starter motor if said engine is not running after said first predetermined time; (iv) second control means responsive to said first timing signal for enabling said first control means to generate said first control signal a predetermined number of times in response to said start command if said engine status signal is not present after said first predetermined time has elapsed;

(v) counting means for counting a number of times said first control signal is generated in order to determine the number of attempts made by said start command, wherein said enabling of said first control means by said second control means is conditioned upon said number of attempts being less than said predetermined number;

(e) means for pumping said accelerator in response to a second control signal wherein said first control means further includes means for generating said second control signal to cause said accelerator pumping means to pump said accelerator;

wherein said first control means further includes second timing means for producing a second timing signal a second predetermined amount of time after said stopping of said first control signal, said second control means being also responsive to said second timing signal, said second means causing said first control means to generate said first control signal if said engine is not running, said number of times is less than a predetermined number, and said second predetermfined amount of time has elapsed after said stopping of said first control signal; and (f) a remote transmitter located externally of said automobile, a receiver located in said automobile and coupled to said start command entering means, and remote start command entering means connected to said remote transmitter for causing said remote transmitter to transmit said start command to said receiver, said receiver including means for detecting said transmitted start command and entering said transmitted start command to said system;

whereby, said first control means attempts to restart said engine a plurality of times in response to said start command if the earlier attempts fail to start said engine in response to said start command.

2. The system of claim 1 wherein said command entering means includes:

(1) remote switch means for producing a remote signal representing said start command;

(2) remote transmitter means connected to said remote switch means for transmitting a radio frequency signal representing said start command and in response to said remote signal;

(3) receive means located in said automobile for receiving and detecting said radio frequency signal to produce a signal representing said start command signal.

3. The system of claim 1 further including means for automatically controlling a plurality of accessories in said automobile, said accessory controlling means including:

(a) means for entering a plurality of accessory control commands into said system;

(b) a plurality of accessories in said automobile responsive to respective ones of said accessory control signals;

(c) second control means for generating said accessory control signals in response to respective ones of accessory control commands;

wherein said command entering means includes (1) a keyboard having a plurality of switches and encoding means for producing encoded command signals corresponding, respectively, to each of said switches;

(2) means for storing a predetermined number of said encoded command signals in an order respresentative of the order of actuating a number of said switches equal to said predetermined number;

(3) means for storing information representing predetermined valid sequences of encoded command signals corresponding, respectively, to valid commands;

(4) comparing means for comparing the contents of said storing means to said predetermined valid sequence information to determine if a valid command has been entered by means of said keyboard; and (5) means responsive to said comparing means for enabling said second control means to enable said first control means only if a valid command has been entered.

4. The system of claim 3 wherein said movable element includes a window and a door of said automobile and said motive means includes a motor and a mechanism connected to said motor and said window for controllably opening and closing said window.

5. The system of claim 3 wherein said second control means includes:

(a) an accessory having an element which is movable between first and second positions;

(b) motive means connected to said element for controllably moving said element to said first and second positions;

(c) means for controllably coupling power from a battery to said motive means to cause said motive means to move said element to said first and second positions in response to third and fourth control signals, respectively;

(d) first position sensing means for generating a first position signal in response to presence of said element in said first position;

(e) timing means for producing a first timing signal a predetermined amount of time after said third control signal is generated; and (f) control means responsive to said timing means and said first position signal for generating said third control signal in response to said first command if said element is not in said first position and said first timing signal has not occurred;

whereby said motive means is prevented from drawing excessive power from said battery if said position sensing means fails to generate said first position signal.

* * * * *